US010206459B2

(12) United States Patent
Grandin

(10) Patent No.: US 10,206,459 B2
(45) Date of Patent: Feb. 19, 2019

(54) CLOSURE DEVICE FOR A SPORTS FOOTWEAR

(71) Applicant: Tecnica Group S.P.A., Giavera del Montello (TV) (IT)

(72) Inventor: Giorgio Grandin, Giavera del Montello (IT)

(73) Assignee: Tecnica Group S.P.A., Giavera del Montello (TV) (IT)

( * ) Notice: Subject to any disclaimer, the term of this patent is extended or adjusted under 35 U.S.C. 154(b) by 370 days.

(21) Appl. No.: 15/042,824

(22) Filed: Feb. 12, 2016

(65) Prior Publication Data

US 2016/0235165 A1 Aug. 18, 2016

(30) Foreign Application Priority Data

Feb. 16, 2015 (IT) ..... 102015000006308

(51) Int. Cl.
*A43C 11/14* (2006.01)
*A43C 11/00* (2006.01)
*A43B 5/04* (2006.01)

(52) U.S. Cl.
CPC ..... *A43C 11/1406* (2013.01); *A43B 5/04* (2013.01); *A43C 11/142* (2013.01); *A43C 11/144* (2013.01)

(58) Field of Classification Search
CPC . A43C 11/1406; A43C 11/142; A43C 11/144; A43C 11/1446; A43B 5/04
See application file for complete search history.

(56) References Cited

U.S. PATENT DOCUMENTS 3,258,820 A 7/1966 Steinberg
4,051,611 A * 10/1977 Chalmers ..... A43C 11/1413 24/68 SK
4,433,457 A * 2/1984 Chalmers, II ..... A43C 11/1406 24/68 SK
5,509,180 A * 4/1996 Benetti ..... A43C 11/1406 24/68 SK
5,575,045 A * 11/1996 Chu ..... A43C 11/146 24/68 SK
5,586,367 A * 12/1996 Benoit ..... A43B 3/0052 24/270
5,768,804 A * 6/1998 Goggia ..... A43C 11/1406 24/68 SK (Continued)

FOREIGN PATENT DOCUMENTS

AT 506481 A1 9/2009
DE 3132042 A1 5/1982

(Continued)

*Primary Examiner* — Jila M Mohandesi
(74) *Attorney, Agent, or Firm* — Howson & Howson LLP

(57) ABSTRACT

A closure device for a sports footwear s provided. The device facilitates insertion of the user's foot into the footwear and extraction of the same from the footwear. The closure device can switch from a closed position, in which the user's foot is immobilized within the footwear, to an open position in which the user's foot can be inserted into the footwear or extracted therefrom, and the device can be locked in a fixed position both when it is in its closed position and when it is in its open position. In particular, when it is in its open position, the closure device is locked in a position in which it does not hinder the operations of inserting the user's foot into the footwear and of extracting the user's foot from the footwear.

11 Claims, 4 Drawing Sheets

(56) References Cited

U.S. PATENT DOCUMENTS

| | | | | |
|---|---|---|---|---|
| 5,845,371 | A | 12/1998 | Chen | |
| 7,603,795 | B2 * | 10/2009 | Pallatin | A43B 5/0415 24/68 SK |
| 8,065,820 | B2 | 11/2011 | Sartor et al. | |
| 8,458,860 | B2 * | 6/2013 | Fregoni | A43C 11/1453 24/68 SK |
| 9,339,083 | B2 * | 5/2016 | Benetti | A43C 11/142 |

FOREIGN PATENT DOCUMENTS

| | | | |
|---|---|---|---|
| EP | 1444911 | A1 | 8/2004 |
| EP | 1743542 | A1 | 1/2007 |
| EP | 2198730 | A1 | 6/2010 |
| FR | 2966020 | A3 | 4/2012 |
| IT | PD20120341 | A1 | 5/2014 |

* cited by examiner

CLOSURE DEVICE FOR A SPORTS FOOTWEAR

BACKGROUND

The present invention relates to a closure device for a sports footwear. More particularly, the present invention relates to a closure device which facilitates insertion of the user's foot into a footwear and extraction of the same from the footwear.

As is known, ski boots and other sports footwear provided with a substantially rigid outer shell have a longitudinal opening allowing to widen the outer shell in order to allow the user to insert his/her foot into the footwear item and extract it therefrom and are equipped with a series of closure devices which are arranged transversely to the longitudinal opening and by means of which the footwear item can be closed so as to immobilize the user's foot within the footwear during the practice of sports.

In particular, closure devices are known comprising a supporting plate adapted to be rigidly attached to a first side of the longitudinal opening of the shell, a closure lever hinged to the supporting plate, and a tensioning member which at a first end is hinged to a central portion of the closure lever and at a second end is provided with hooking elements for engaging with an anchoring plate (for instance a toothed rack) rigidly attached to a second, opposite side of the opening of the shell.

The lever is hinged to the supporting plate so as to be rotatable between a closed position and an open position.

In the closed position, the hooking elements of the tensioning member are firmly fastened to the anchoring plate and the distance between the supporting plate and the anchoring plate—and therefore the distance between the two sides of the opening of the shell—is fixed and determined by the size and the position of the tensioning member.

In the open position, the hooking elements of the tensioning member are disengaged from the anchoring plate and the distance between the two sides of the opening of the shell can be varied, in particular the distance can be increased so as to widen the opening of the shell and facilitate insertion of the user's foot into the footwear or extraction therefrom.

However, in known footwear, these operations of inserting and extracting the foot may be not so comfortable.

Indeed, although the hooking elements of the tensioning members of the closure devices are disengaged from the corresponding anchoring plates, the closure devices may still be of hindrance in performing the aforesaid operations.

Indeed, after the hooking elements have been disengaged, the closure devices are still positioned through and above the opening of the shell, so that they constitute an obstacle to the widening of the opening.

In addition, there exists the risk that the hooking elements get inadvertently caught in the anchoring plate, thus blocking widening of the opening and forcing the user to free them again. Since the user may have to carry out such operation in difficult conditions (for example with hands numb from the cold or when wearing thick gloves), this operation may be difficult.

In prior art there are known sports footwear in which the closure device can be locked in different positions, and particularly in a first position in which the user's leg is immobilized within the footwear, and in a second position in which the user's leg has some freedom of movement within the footwear. For example, in case of applications to the specific field of boots for ski mountaineering, such solutions can be used for locking the closure devices in an optimal position for the downhill phase and in another optimal position for the uphill phase. Examples of such solutions are illustrated in documents EP 2 116 145 and EP 2 198 730.

However, in the aforementioned solutions, the closure devices are again arranged through and above the opening of the shell and hinder widening thereof.

In particular, in the aforementioned solutions, both in the first and in the second position the tensioning member of the closure device is engaged with an anchoring plate provided on the opposite side of the longitudinal opening of the shell of the sports footwear.

The main object of the present invention is to overcome the limitations of prior art by providing a closure device for sports footwear which can shift from a closed position to an open position and—in the open position—makes it particularly comfortable for the user to insert and extract his/her foot into and from the footwear, respectively.

This and other objects are achieved with the closure device as claimed in the appended claims.

SUMMARY

According to the invention, the closure device for sports footwear can shift from a closed position to an open position and can be locked in both of these two positions; namely:

- in the closed position, locking of the closure device is effected by means of the engagement of first hooking elements with retaining elements of the anchoring plate; and
- in the open position, locking of the closure device is effected by means of the engagement of second hooking elements with retaining elements of the supporting plate.

Owing to this measure, in the open position of the closure device the tensioning member, the closure device can be engaged with the supporting plate so as to be moved away from the opening of the shell as well as from the anchoring plate located on the opposite side of the opening. In particular, in the open position the tensioning member of the closing device will be entirely disengaged from the anchoring plate.

In this way the opening of the shell is completely free and no obstacle prevents or hinders widening thereof.

Advantageously, the second hooking elements of the tensioning member and the retaining elements of the supporting plate are configured so that, when the second hooking elements of the tensioning member are engaged with the retaining elements of the supporting plate, the tensioning member is locked in a position in which it forms, with the supporting plate, an angle greater than 45°, and preferably greater than 60°.

This measure guarantees that the tensioning member is locked in a position in which it is far enough from the opening of the shell and does not hinder widening thereof.

BRIEF DESCRIPTION OF THE DRAWINGS

Further features and advantages of the invention will become more apparent from the following detailed description of some preferred embodiments of the invention, given by way of non-limiting example with reference to the annexed drawings, in which.

DETAILED DESCRIPTION

Figure 1:
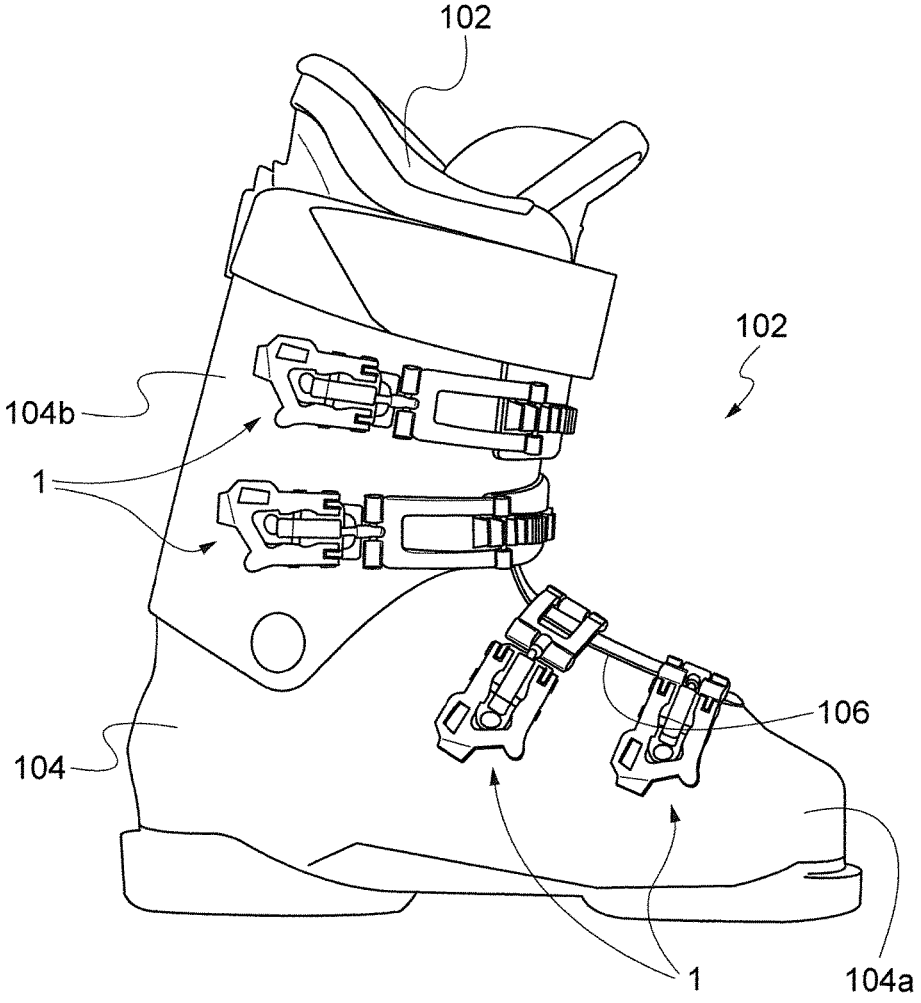
FIG. 1 shows a sports footwear provided with a plurality of closure devices according to the invention.

Referring at first to FIG. 1, there is schematically illustrated a ski boot 100.

The ski boot 100 essentially comprises an inner liner 102 made of a substantially soft material and a shell 104 made of a substantially rigid material. Both the inner liner and the outer shell comprise a lower portion for receiving the user's foot and a cuff for receiving the ankle and the lower part of the user's calf (only the lower part of which 104*a* and the cuff 104*b* of the shell are visible in FIG. 1).

At least the outer shell 104 comprises a longitudinal opening 106 extending along the lower part 104*a* and the cuff 104*b*. Thanks to the presence of the longitudinal opening, the inner volume defined within the outer shell 104 can be varied.

The boot 100 further comprises a plurality of closure devices 1 according to the invention, arranged along the longitudinal opening 106 and transversely thereto.

In a manner known per se, the closure devices 1 can be moved from a closed position—in which the distance between the two opposite sides of the opening 106 of the shell 104 is fixed and the user's foot is immobilized within the ski boot 100—to an open position—in which the distance between the two opposite sides of the opening 106 of the shell 104 can be varied, in particular increased, and the user's foot can be inserted into the ski boot 100 or extracted therefrom.

Figure 2:
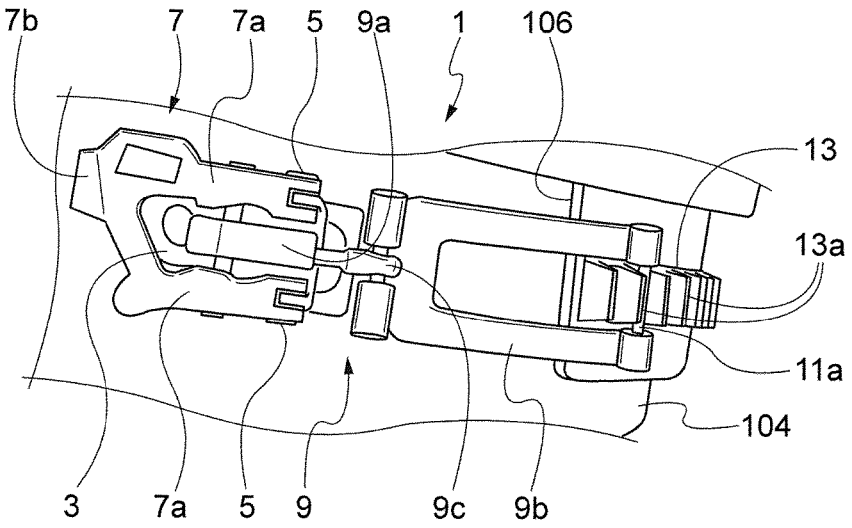
FIG. 2 is a detailed representation of the closure device according to the invention, shown locked in its closed position.

In FIG. 2 there is illustrated in greater detail a closure device 1 according to the invention, shown in its closed position.

The closure device 1 comprises a supporting plate 3 intended to be fixed to the shell 104 of the ski boot 100, on a first side of the longitudinal opening 106. To this aim, the supporting plate 3 is provided with through-holes for passage of corresponding fasteners for fastening to the shell.

A closure lever 7 is pivotally connected to the supporting plate 3 by means of pivoting pins 5. For this purpose, the closure lever 7 has at a first end a pair of parallel arms 7*a* provided with holes for the passage of the pins 5; at its second, opposite end, the closure lever has instead a gripping portion 7*b* that the user can grasp for actuating rotation of the closure lever in order to make it shift from the closed position to the open position and vice versa.

The closure device 1 further comprises a tensioning member 9 which at one end has a connecting portion 9*a*, which is articulated to the closure lever 7 by means of pins 15*a* with the interposition of an elastic member 15*b* (for example a spring), and at the second, opposite end has a hooking portion 9*b*, the portions being preferably connected to each other in an articulated way by means of a joint 9*c*.

The hooking portion 9*b* of the tensioning member 9, at its end opposite to the connecting portion 9*a*, is provided with first hooking elements 11*a* that are adapted to engage with retaining elements 13*a* of an anchoring plate 13 which is fixed to the shell 104 of the boot 100, on a second side opposite to the longitudinal opening 106.

Preferably, the anchoring plate 13 has a plurality of differently positioned retaining elements 13*a*, whereby the tensioning member 9 can engage with the anchoring plate in a plurality of different positions. The anchoring plate 13 can be configured for example as a toothed rack comprising a plurality of teeth 13*a* arranged in series; in this case, the first hooking elements 11*a* of the tensioning member 9 can be correspondingly configured as a web suitable for engaging into one of the teeth 13*a* of the anchoring plate.

Depending on the position in which the tensioning member 9 engages with the anchoring plate 13, the two sides of the opening 106 of the shell 100 are drawn closer to each other to a larger or smaller extent, whereby the inner volume of the shell 104 can be adjusted as a function of the morphology of the foot of a specific user.

Figure 3:
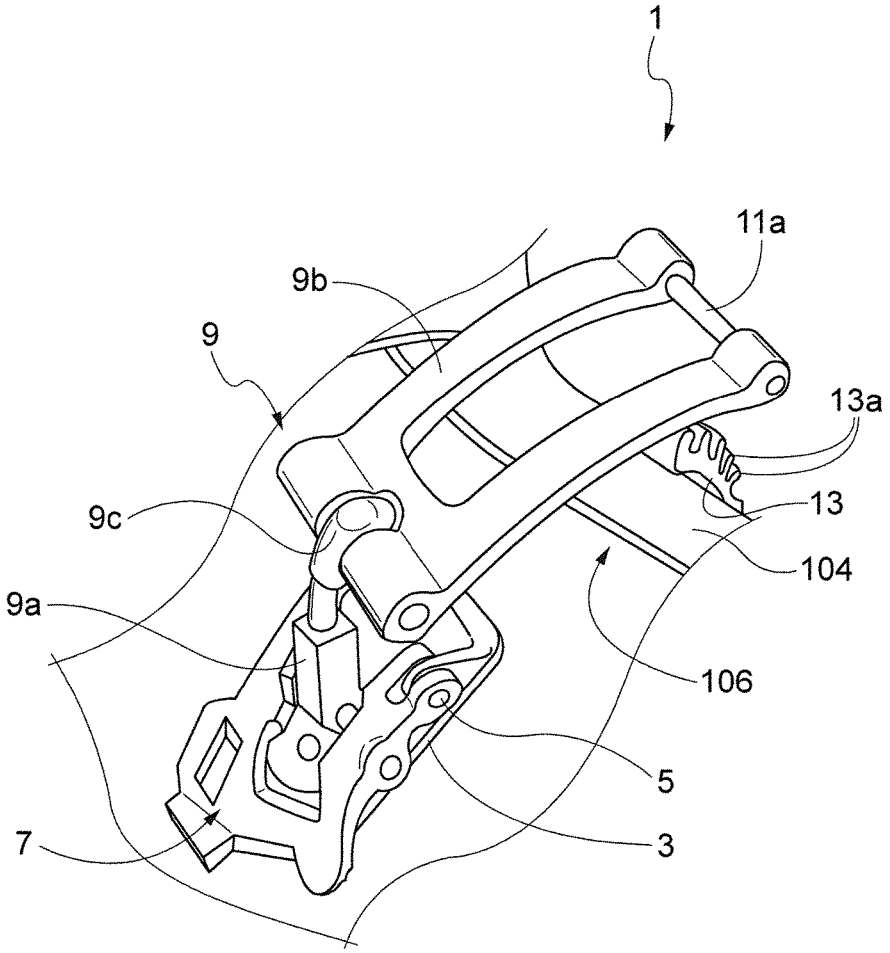
FIGS. 3 and 4 are detailed representations of a closure device according to the invention, shown locked in its open position.
Figure 4:
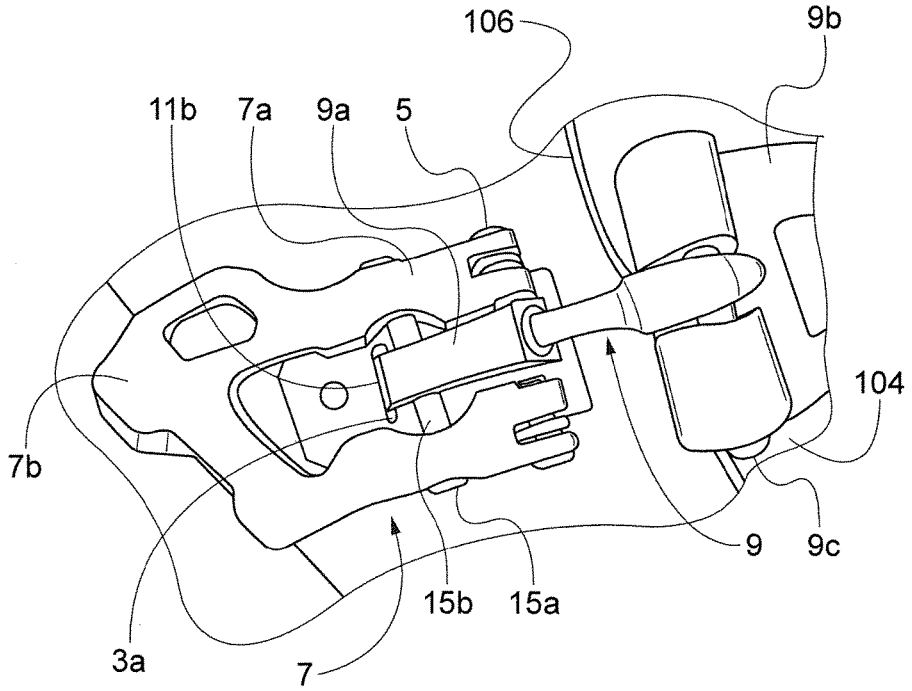

In FIG. 3 and in FIG. 4 the closure device 1 according to the invention is shown in its open position.

According to prior art, in the open position the hooking elements of the tensioning member are disengaged from the retaining elements of the anchoring plate and the tensioning member is not engaged at all in a fixed position. Consequently, it tends to remain leaning on the anchoring plate if not at least partially engaged with it, so as to be still disposed over the longitudinal opening of the shell, transversely thereto.

On the contrary, according to the invention, the tensioning member 9 of the closure device 1 comprises second hooking elements 11*b* which are adapted to engage with retaining elements 3*a* of the supporting plate 3 when the closure device 1 is in its open position, so that the tensioning member 9 is in a fixed position also in this open position.

In particular, the second hooking elements 11*b* of the tensioning member 9 and the retaining elements 3*a* of the supporting plate 3 will be configured in such a way that the tensioning member 9 is locked in a position in which it is completely disengaged from the anchoring plate 13 and is far enough from the opening 106 of the shell 104 not to hinder widening thereof.

To this aim, the second hooking elements 11*b* of the tensioning member 9 and the retaining elements 3*a* of the supporting plate 3 will be configured in such a way that—in the open position of the closure device 1—the tensioning member 9 forms, with the supporting plate 3, an angle greater than 45°, and preferably greater than 60°.

Preferably, the second hooking elements 11*b* of the tensioning member 9 are provided in the connecting portion 9*a* of the tensioning member 9, in particular in the vicinity of the end of the connecting portion opposite to the hooking portion 9*b*.

According to a preferred embodiment of the invention, the second hooking elements 11*b* consist of the end part of the connecting portion 9*a* of the tensioning member 9, which is shaped so as to be capable of engaging into the retaining elements 3*a* of the supporting plate 3.

Correspondingly, in this embodiment of the invention, the retaining elements 3*a* of the supporting plate 3 consist of a recess in the surface of the supporting plate shaped so as to be capable of retaining the end part of the connecting portion 9*a* of the tensioning member 9.

It is apparent that this embodiment is not to be considered as limiting and that any other solutions within the reach of the person skilled in the art for the making of the second hooking elements 11*b* of the tensioning member 9 and of the retaining elements 3*a* of the supporting plate 3 can be implemented as well.

In particular, the hooking elements 11*b* of the tensioning member 9 and the retaining elements 3*a* of the plate 3 do not necessarily have to be mechanical elements, but they may also be of a different type, for example magnetic.

The operation of the closure device 1 will be apparent to the person skilled in the art.

From the closed position shown in FIG. 2, in which the first hooking elements 11*a* of the tensioning member 9 are engaged with the retaining elements 13*a* of the anchoring plate 13, the user can act upon the closure lever 7 and rotate the closure lever 7 for moving it away from the supporting plate 3 (i.e. clockwise in the Figures). In this way it will be possible to disengage the first hooking elements 11*a* of the tensioning member 9 from the retaining elements 13*a* of the anchoring plate 13.

While maintaining the first hooking elements 11*a* of the tensioning member 9 disengaged, the user can rotate the closure lever 7 for drawing it close to the supporting plate 3 (i.e. counterclockwise in the Figures) again, thus bringing the second hooking elements 11*b* of the tensioning member 9 into engagement with the retaining elements 3*a* of the supporting plate 3.

In this configuration—corresponding to the open position shown in FIG. 3 and in FIG. 4—the closure device 1 will be firmly positioned in a configuration in which it does not hinder the widening of the longitudinal opening of the shell.

By rotating again the closure lever 7 for drawing it away from the supporting plate 3 (i.e. clockwise in the Figures), it will be possible to disengage the second hooking elements 11*a* of the tensioning member 9 from the retaining elements 3*a* of the supporting plate 3 and bring the first hooking elements 11*a* of the tensioning member 9 into engagement in the desired position with the retaining elements 13*a* of the anchoring plate 13.

By rotating the closure lever 7 for drawing it close to the supporting plate 3 (i.e. counterclockwise in the Figures), the first hooking elements 11*a* of the tensioning member 9 will be locked relative to the retaining elements 13*a* of the anchoring plate 13 and the device 1 will be again in its closed position.

From the above description it is apparent that the closure device according to the invention allows to fully attain the object set forth above.

It is further evident that what has been described in connection with the preferred embodiment shown has been provided by way of non-limiting example, and that several modifications and variants are available to the person skilled in the art without departing from the scope of the invention as defined in the appended claims.

In particular, while the embodiment described above refers to a ski boot, it is apparent that the invention could also be applied to other kinds of sports footwear comprising an upper having a longitudinal opening and one or more closure device(s) arranged along the longitudinal opening and transversely thereto.

I claim:

1. A closure device for a sports footwear, comprising:

a supporting plate intended to be fixed to the sports footwear and having a supporting plate retaining element;

a closure lever pivotally connected to the supporting plate;

a tensioning member pivotally articulated to the closure lever with the interposition of an elastic member and having a first hooking element and a second hooking element; and an anchoring plate intended to be fixed to the sports footwear and provided with anchoring plate retaining elements;

wherein the closure device can be switched from a first, closed position to a second, open position and vice versa; and wherein, when the closure device is in the first, closed position, the first hooking element of the tensioning member engages the anchoring plate retaining elements, thereby locking the tensioning element relative to the anchoring plate, while the second hooking element of the tensioning member is disengaged from the supporting plate retaining element, and when the closure device is in the second, open position, the second hooking element of the tensioning member engages the supporting plate retaining element, thereby locking the tensioning element relative to the supporting plate, while the first hooking element of the tensioning member is disengaged from the anchoring plate retaining element.

2. The closure device according to claim 1, wherein the tensioning member comprises a connecting portion pivotally articulated to the closure lever and a hooking portion, the connecting portion and the hooking portion being connected by a joint and wherein the first hooking element is provided on the hooking portion of the tensioning member and the second hooking element is provided on the connecting portion of the tensioning member.

3. The closure device according to claim 2, wherein the first hooking element is provided on the hooking portion of the tensioning member at the end of the hooking portion of the tensioning member opposite to the connecting portion of the tensioning member and the second hooking element is provided on the connecting portion of the tensioning member at the end of the connecting portion of the tensioning member opposite to the hooking portion of the tensioning member.

4. The closure device according to claim 1, wherein the anchoring plate has a number of differently positioned retaining elements, whereby the tensioning member is selectively engageable with the anchoring plate in a number of different positions.

5. The closure device according to claim 1, wherein the second hooking element of the tensioning member and the supporting plate retaining element are mechanical elements co-operating with each other.

6. The closure device according to claim 5, wherein the tensioning member includes a connecting portion pivotally articulated to the closure lever, wherein the second hooking element is an end part of the connecting portion of the tensioning member, wherein the supporting plate retaining element is a recess a surface of the supporting plate, and wherein the end part of the connecting portion of the tensioning member and the recess in the surface of the supporting plate are shaped so that the end part of the connecting portion of the tensioning member is held in the recess in the surface of the supporting plate when the closure device is in the second, open position and is disengaged from the recess when the closure device is in the first, closed position.

7. The closure device according to claim 1, wherein the second hooking element of the tensioning member and the supporting plate retaining element are magnetic elements co-operating with each other.

8. The closure device according to claim 1, wherein the second hooking element of the tensioning member and the supporting plate retaining element are designed so that the tensioning member is completely disengaged from the anchoring plate when the closure device is in the second, open position.

9. The closure device according to claim 1, wherein the second hooking element of the tensioning member and the supporting plate retaining element are designed so that the tensioning member forms an angle greater than 45° with the supporting plate when the closure device is in the second, open position.

10. A sports footwear, comprising at least an upper provided with a longitudinal opening, and comprising at least one closure device according to claim 1, the supporting plate of the closure device being fastened to the sports footwear upper on a first side of the longitudinal opening of the sports footwear upper and the anchoring plate of the closure device being fastened to the sports footwear upper on a second, opposite side of the longitudinal opening of the sports footwear upper.

11. The closure device according to claim 1, wherein, when the closure device is in the second, open position, the tensioning member forms an angle of greater than 60° with the supporting plate.

* * * * *